United States Patent [19]

Otala et al.

[11] Patent Number: 4,742,893

[45] Date of Patent: May 10, 1988

[54] SIGNALLING PROCEDURE FOR A LIFT AND A SIGNALLING SYSTEM

[75] Inventors: Matti Otala, Helsinki; Osmo Ivanto, Hyvinkää; Matti Kähkipuro, Hyvinkää; Urpo Sten, Hyvinkää, all of Finland

[73] Assignee: Elevator GmbH, Baar, Switzerland

[21] Appl. No.: 852,367

[22] Filed: Apr. 15, 1986

[51] Int. Cl.[4] ..... B66B 1/14

[52] U.S. Cl. ..... 187/121; 187/130

[58] Field of Search ..... 187/29 R, 101, 130, 187/121; 340/19, 20, 21; 364/200

[56] References Cited

U.S. PATENT DOCUMENTS 3,456,242 7/1969 Lubkin et al. ..... 364/200

3,659,271 4/1972 Collins et al. ..... 364/200

*Primary Examiner*—William M. Shoop, Jr.

*Assistant Examiner*—Richard K. Blum

*Attorney, Agent, or Firm*—Browdy and Neimark

[57] ABSTRACT

The invention concerns, first, a signalling procedure for a lift, whereby the control system and the users of the lift are informed on lift calls and the state of the lift, e.g. position, movement and availability, by using serial communication between the control system computer and the actuating and signalling means in the lift car and on each floor level, and, second, a signalling system applying the said procedure. To avoid abundant and complicated wiring and to increase standardization in the design of the lift system main panel and call button stations, the signalling system of the invention employs the polling principle in its internal communication, whereby data are transmitted bi-directionally using digital series loops, one of which connects the devices in the lift car, controlled by and communicating via a microprocessor, another connects the corresponding shaft and door devices, while a third loop is used for communication with the external world.

7 Claims, 1 Drawing Sheet

SIGNALLING PROCEDURE FOR A LIFT AND A SIGNALLING SYSTEM

Figure 1:
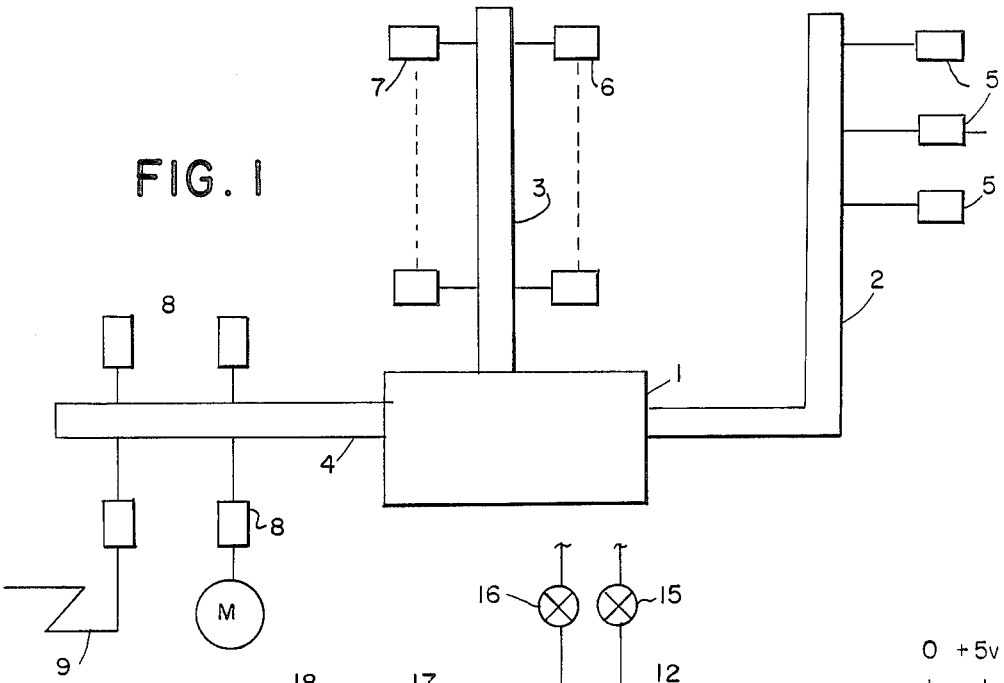

The present invention concerns a signalling procedure for a lift and a signalling system, in which the control system and the users of the lift are informed on the lift calls and the state of the lift, e.g. position, movement and availability, by using serial data transmission between the control system computer and the actuating and signalling devices in the lift car and on each floor of the building.

An integral part of the lift system are the call buttons and the various signal lights which inform the user about the position, travelling direction and arrival of the lift. These functions must be provided on each floor and they are often incorporated in a single unit constituting a call button station. The lift control system, which receives the calls and controls the lift motor, is generally located in the machine room at the upper end of the lift shaft. A modern control system is fully electronic, consisting of electronic organs placed on circuit cards housed together in the control panel or main panel of the lift system.

In present-day lift control systems, the wiring for the call buttons and signal lights has to be carried all the way from the call button stations to the main panel. Therefore, in prior art lift systems there is a bundle of conductors running from each floor to the machine room. At the main panel, these bundles together constitute quite a tangle. There are also systems in which at least part of the required information is transferred in a multiplexed form via a common route from the lift buttons and similar devices to the control system.

The installation of the wire bundles implies careful planning and a great deal of preparation, especially because in most cases the wiring has to be designed individually for each order according to the varying number of floors and characteristics of the call button stations. Multiplexed systems provide an improvement regarding the wiring problems, but their reliability is not the best possible in environments subject to interference. Moreover, this method of communication, using a minimum of wiring, requires the use of rather complex transmission and reception logic.

An important area affected by the present invention is lift maintenance. Formerly, faults in a lift system were only detected after the lift had failed, and the faults were located via measurements. Fault statistics had to be compiled from the maintenance reports drawn up by maintenance personnel, thus covering only the detected and corrected faults.

The object of the present invention is to avoid the drawbacks mentioned and to provide a lift signalling system which uses few wires and standard parts for all control functions, so that the only individual adaptation that remains to be provided separately fro each order is the programming, implemented at the site of installation, which enables the lift system traffic analysis and fault location to be either substantially simplified or performed automatically.

To accomplish these aims, the invention is mainly characterized in that communication is effected on the polling principle by means of digital series loops used bi-directionally in such manner that one of the loops connects the lift car devices, controlled by and communicating via a microprocessor, another connects the corresponding shaft and door devices on each floor, while a third loop handles communication with the external world.

The polling principle in itself is a well known communication protocol used for data transmission between two devices at a time without multiplexing. The digital series loops may be made of optical fibre, which case the lift car cable will be light and cheap and more reliable, while the installation costs will be lower. The most important consequence of this is that, thanks to the serial data transmission, the wiring of the call button stations is decisively reduced. A further advantage is flexibility of installation, since the same standard assembly may be used with different types of call button station by programming them appropriately to suit different conditions. The number and kind of signalling devices in each call button station and the required specific information regarding the particular system and each floor can be programmed on site into the microprocessor of each call button station. To achieve this in practice, it is only necessary to connect e.g. mechanical switches across certain terminals of the microprocessor. From the position of these switches, using its mask program, the processor is then able to derive the value of each parameter.

Use of mass-produced devices, for instance the use of a mask-programmed single-chip processor is far more advantageous than implementing the signalling in the conventional way with the abundant wiring involved.

An advantageous embodiment of the procedure of the invention is characterized in that the serial communication between the processors is so implemented that the lift control system computer, placing itself alternately into transmitting and receiving modes, queries each loop processor in turn about its state. The processor thus addressed, upon receiving the enquiry, switches over from reception to transmission and sends the requested information to the main processor, whereupon it reverts to the receive mode.

This type of simple line discipline can be managed by any single-chip microcomputer while at the same time maintaining signalling with respect to the users.

An advantageous embodiment of the procedure of the invention is also characterized in that, to ensure correct data transfer in the loops, the data transmitted by the control computer is echoed back to it via the other branch of the loop by means communication controllers, the control computer then comparing the transmitted data to the data received and thus checking whether the transmission was performed successfully. This means that the data transmitted will reach the processor addressed even if the loop should be broken at some point. This security function can easily be further enhanced by enabling the control computer to transmit and receive data along both branches of the loop simultaneously in situations when there is a fault in the loop, i.e. when the comparison yields a negative result. This makes it earier to trace the faults.

A signalling system applying the procedure of the invention and using the lift system control computer to control communication, in which the individual units comprised in the communication system and addressed by the control computer are constituted by call button stations located on each floor or inside the lift car and incorporating the lift call or floor buttons and a desired number of signalling devices, known in themselves in the art, indicating the state or position of the lift, is characterized in that each call button station incorporates a micorprocessor controlling and supervising the operation of the station and also constituting a communication controller, and that all signalling devices of the lift system are thus connected via the microprocessors to the lift control computer by means of digital series loops in such manner that one of the loops connects the devices inside the lift car, while another connects the corresponding devices in the shaft and on each floor, and a third loop provides a connection for external devices, such as measuring equipment etc.

An advantageous embodiment of the signalling system of the invention is characterized in that the third digital series loop is adapted for connection to a fault locating and analyzing unit. When a fault analyzing unit is connected to the digital series loop, a microprocessor-based printer unit is also connected to the loop. By means of the fault analyzing unit, it is possible to accomplish fault location analysis comprising the supervision of loop traffic and the monitoring of irregularity of CRC error correction and similarity of automatic retransmission. The fault analyzing unit is also used for lift traffic analysis, comprising collection of statistical lift traffic data, recognition of the traffic pattern and reporting on the main characteristics of the principal traffic, lift use and invoicing of the client. Such a unit is transportable and can be connected to the lift loops on request or at system start-up, the required information being gathered from the loops without altering the central unit programs.

The new invention makes it possible to obtain accurate information and reliable measurement results about the lift in its various phases of traffic. Other advantageous embodiments of the signalling system of the invention are characterized by what is presented in the claims hereinafter.

Figure 2:
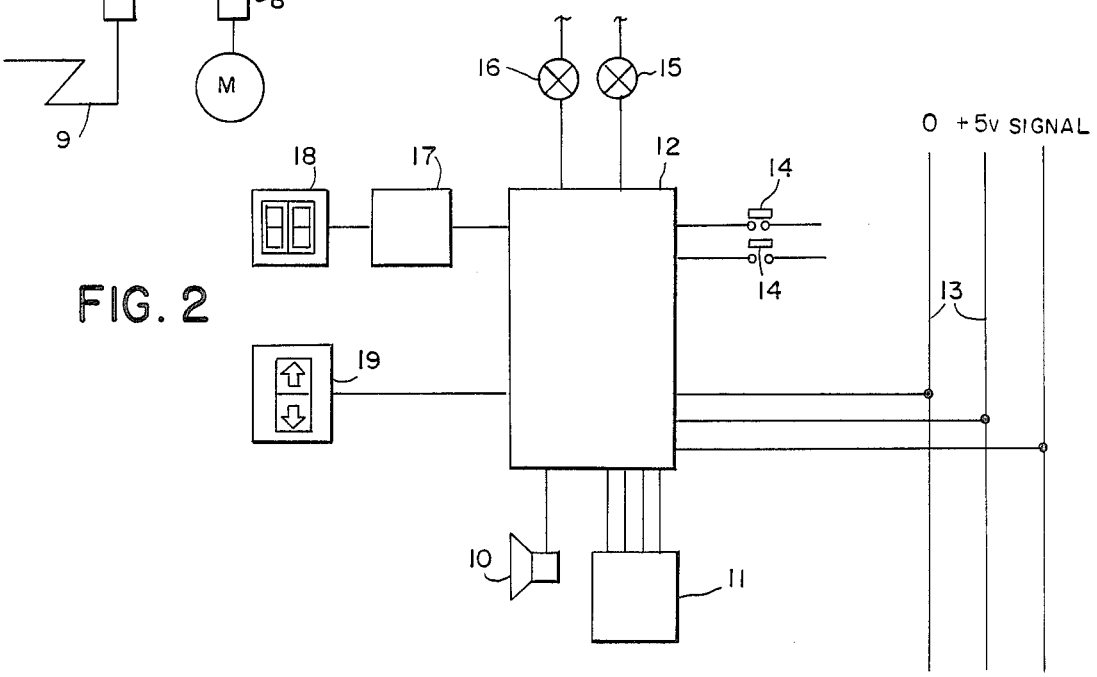
Figure 3:
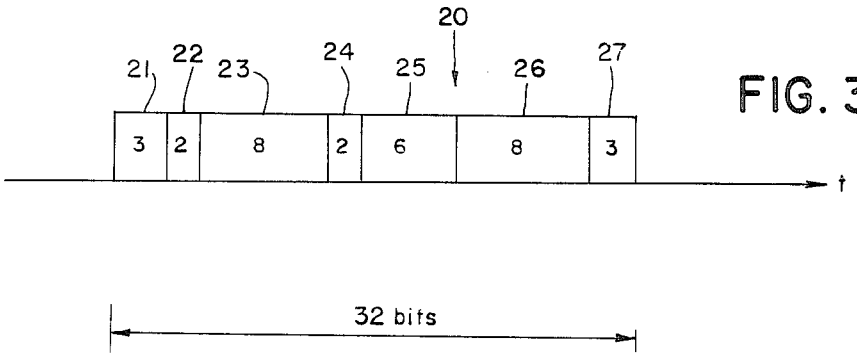

In the following, the invention is described in greater detail by the aid of an example, reference being made to the drawings attached, wherein:

FIG. 1 presents digital series loops connected to the lift control computer according to the invention, together with the signalling units connected to them, FIG. 2 presents the connection of floor level signalling devices to a microprocessor and further to a digital series loop according to the invention, FIG. 3 presents an example of the 32-bit standard message used in the digital series loops.

FIG. 1 shows the lift control computer 1 and three digital series loops 2, 3, and 4 connected to it. These loops are used for data transmission in such manner that the car loop 2 connects the devices 5 in the lift car (call button station, floor indicators etc.) to the lift control computer or central unit 1, the shaft and door loop 3 connects the shaft devices 7 (mot of these being various switches) and the service devices 6 (call button stations on each floor) to the central unit, while the third or external loop 4 connects the various supervision and reporting devices 8*a*, and the lift motor control devices 8 to the central unit 1. In addition, reference number 9 indicates a communication link to the external world, e.g. a telephone line or a radio link connection to a lift maintenance company.

The central unit 1 monitors the loops 2–4 and, on the basis of the density of data traffic in each, assigns them an order of priority. The loops are so connected that transmission in both directions is possible. In a normal situation, the data transmitted via one of the loop branches is circulated around the loop in such manner that the transmitting device can, by reading the other branch, verify whether the data transmitted has passed correctly through the loop. In the case of an interruption or other disturbance in the loop, both branches of the loop are used for transmission and reading, still addressing only one device at a time. In this way, the signal will reach the destination via one branch or the other, and the fault can easily be reported.

FIG. 2 shows an example of a basic unit made possible by serial communication as employed in the procedure of the invention. The unit consists of a microprocessor 12 with a fairly large number of peripheral signalling devices connected to it, such a unit being mounted on each floor. The push buttons 14 are the lift call buttons, one for the up direction, the other for the down direction. The lamp 15 is a signal light which is lit when the lift arrives, and the lamp 16 indicates that the lift is not in use. Item 17 is a parallel input/output circuit used for controlling the floor indicator circuit 18. Lift travel direction is indicated by the signal lights 19. The loudspeaker 10 announces the arrival of the lift, thus providing an aid e.g. to the visually handicapped. In addition, the processor can be programmed to deliver other acoustic signals as well. In this example, power is supplied to the unit via supply lines 13 running in parallel with loop 3.

The data individual to the particular installation are programmed into the level processor by means of the connecting box 11. These data pertain in the first place to the number and kind of devices in the level processor's operating environment, i.e. the processor is informed on the composition of the call button station. The information pertaining to the entire system, such as the number of floors, position of the lift etc., is supplied to the lift's main panel by programming it into the central unit 1.

In a normal situation, the serial communication in the shaft and door loop 3 proceeds as follows: When a lift call button 14 is pressed, a certain flag in an internal register in the microprocessor 12 is set to a certain state. The normal state of the level processor on the 'signal' line is the input state, i.e. the receiving mode. The main processor of the control system continuously queries the level processors about their state by 'polling' each one in turn. On recognizing an inquiry as being addressed to itself, the level processor changes over from input to output state, i.e. from receive mode to transmit mode. At the same time, the main processor switches to input mode. The addressed level processor transmits in serial form the states of its internal registers to the main processor, which sends back an acknowledgement, whereupon both processors again change their operating mode. The sequence is then repeated in like manner for the next level processor. When a call has been registered, the main processor recognizes the content of the respective level processor register as a call and adjusts its own output lines to the lift drive system so as to make the lift motor serve the new call. The polling process is not substantially interrupted hereby, but goes on as a routine.

FIG. 3 presents an example of the standard 32-bit serial message 20 used in the loops. The numbers in the sections refer to the number of bits reserved for each section. Section 21 is the start section, which activates the digital series loop. Section 22 is the transmitter identification code, section 23 contains the address of the transmission, section 24 specifies the category of the data transmitted, section 25 contains the message itself, section 26 contains a CRC error detection code, and section 27 is the stop section, which ends the transmission.

It is obvious to a person skilled in the art that the different embodiments of the invention are not confined to the example presented above but may vary within the scope of the claims stated below. Thus, for instance, the number or kind of functions that can be incorporated in the call button stations are in no way limited, but the level processor functions serving the passengers or lift control may be increased or decreased as required. In addition to the communication function, the micro-processors on the different floor levels can also be used to process and refine information further to give it the form required by the various lift functions.

We claim:

1. A signalling system for a lift, comprising means for controlling communication including a control system computer and a plurality of individual units of a communication system addressed by the control system computer, said individual units being constituted by call button stations located on each floor or inside the lift car and incorporating the lift call or floor buttons and a desired number of signalling means for indicating the state or position of the lift, each call button station incorporating a micro-processor for control and supervision of the operation of the station and also constituting a communication controller, and all said signalling means being connected via the respective micro-processor to the control system computer by means of digital series loops in such manner that one of the loops connects the devices inside the lift car, while another connects the corresponding devices in the shaft and on each floor, and a third loop provides a connection for external devices.

2. Lift call button station according to claim 1, wherein the number and kind of signalling means in the call button station and the required information relating to the particular system or to each particular floor level are programmable into respective the micro-processor at the site of installation.

3. A system according to claim 1, wherein the third digital series loop is adapted for connection to a fault locating and analyzing unit.

4. A system according to claim 1, wherein the digital series loops are made of optical fibre.

5. The system of claim 1, wherein said lift system control computer controls said communication with each said individual unit by sending out on each said digital series loop a respective succession of inquiries addressing in succession each of the individual units of the respective serial loop, and when each individual station has information to be transmitted to the lift system control computer, upon receiving the inquiry addressed to itself, it transmits said information to the lift system control computer.

6. The device of claim 1, wherein information transmitted between said control system computer and each said individual station is transmitted in both directions of the loop, and said information transmitted in one of said directions is used to verify receipt of the same information transmitted in the opposite direction.

7. The system of claim 5, wherein when said control system computer transmits information in both directions on one of said loops, the information travelling in a first direction is first received by the respective addressed individual unit, and the information travelling in the other direction is returned to the control system computer for verification of transmission by the control system computer of the correct information.

* * * * *